United States Patent [19]

Hermann et al.

[11] 4,035,025

[45] July 12, 1977

[54] MINERAL WINNING PLOUGHS

[75] Inventors: Martin Hermann, Lunen; Oswald Breuer, Dortmund-Husen; Alois Hauschopp, Werne, all of Germany

[73] Assignee: Gewerkschaft Eisenhutte Westfalia, Wethmar near Lunen, Germany

[21] Appl. No.: 646,102

[22] Filed: Jan. 2, 1976

[30] Foreign Application Priority Data

Jan. 9, 1975 Germany ..... 2500680

[51] Int. Cl.[2] ..... E21C 27/35

[52] U.S. Cl. ..... 299/34

[58] Field of Search ..... 299/32, 34, 80

[56] References Cited

U.S. PATENT DOCUMENTS

| | | | |
|---|---|---|---|
| 3,785,704 | 1/1974 | Ostrop et al. | 299/34 |
| 3,877,752 | 4/1975 | Hauschopp | 299/34 |

*Primary Examiner*—Ernest R. Purser

*Attorney, Agent, or Firm*—Sughrue, Rothwell, Mion, Zinn and Macpeak

[57] ABSTRACT

A coal plough is composed of two spaced-apart interconnected bodies which engage on a guide and which are moved along the guide to strip coal from a coal face. Each body is provided with various sets of cutter bits located at both its end regions and a floor cutter adjustable to control the height of cutting. The cutter bits at the inner face end regions of the bodies project further outwards towards the coal face than the other bits. During operation when the bodies move in one direction along the guide, cutter bits at the forward outer end region of the leading body cut into the coal face and the following-up cutter bits at the forward inner end region of the lagging body also cut into the face. The remaining cutter bits do not engage on the coal face.

In this way the cutting operation is performed by both bodies and similarly both bodies can assist into transferring the coal detached from the face over the guide and into a scraper-chain conveyor.

16 Claims, 4 Drawing Figures

MINERAL WINNING PLOUGHS

BACKGROUND TO THE INVENTION

The present invention relates in general to a mineral mining installation and more particularly to a mineral or coal winning plough.

As is known, coal ploughs are machines which are supported on a guide usually on a scraper-chain conveyor, in a mine working and which are slidably moved along the guide to strip coal from a coal face by means of cutting tools. In one form of plough two separate bodies, each carrying cutters, are mounted directly on the guide and are interconnected to move together so that coal is stripped from the face in both directions of movement of the plough along the face. In such ploughs it is common for coal to be detached by the cutters on the leading body relative to the direction of movement of the plough and for this coal to be loaded into the conveyor with the aid of the lagging body. Difficulties often occur when coal accumulates in the space between the bodies and becomes jammed. Because of this problem there is a limitation on the amount of coal removed at each pass of the plough.

It is also known to control the plough with the aid of floor cutters and it is often difficult to maintain a desired setting or to adjust such cutters. One form of floor cutter adjustment which has been generally successful involves the use of an arcuate guideway, T-shaped in cross-section and extending generally parallel to the coal face which receives a carrier to which the floor cutter is fixed. (See for example German Pat. No. 1300889). The carrier can move along the guideway and can be secured by a stop pin to adjust the height of the floor cutter. Such devices have proved robust and reliable but hitherto they have only been successful with ploughs employing a sword plate extending beneath the conveyor and engaging with a guide and a drive chain on the side of the conveyor remote from the coal face. In the case of swordless ploughs which engage directly on a guide at the coal face side the provision of floor cutter control devices of the type mentioned has not been a practical proposition chiefly because of limitations on space.

A general object of this invention is to provide an improved form of coal plough.

SUMMARY OF THE INVENTION

In one aspect the invention provides a mineral winning plough composed of two interconnected bodies adapted to be guided on guide means for movement back and forth along a mineral face, each body carrying cutter bits disposed at end regions of the body relative to the directions of movement of the plough which act, during operation, so that, for each direction of movement of the plough, at least some of the cutter bits on the forward end region of the lagging or rearward body, relative to the direction of movement, project towards the mineral face as yet uncut by a greater distance than the cutter bits on the outermost end regions of both the bodies.

In another aspect the invention provides a mineral winning plough composed of two interconnected bodies adapted to be guided on guide means for movement back and forth along a mineral face, each body being provided with at least one floor cutter which is adjustable in relation to the body, a set of cutter bits positionally fixed in relation to the body and disposed at an outer end region of the body remote from the other body and a further set of cutter bits adjustable in relation to the body and disposed at an inner end region of the body facing the other body, the adjustable sets of cutter bits being arranged so that, during operation, for each direction of movement of the plough the adjustable bits on the lagging or rearward body serve to cut away the mineral face to ensure that the fixed cutter bits at the outer end region of said lagging body do not engage on the mineral face.

Preferably the adjustable floor cutter on each body is of the type described hereinbefore employing an arcuate guideway and an inter-engaging carrier.

The fixed cutter bits at the front end region of the leading body relative to the direction of movement of the plough may be adapted to cut away the mineral face and the adjustable bits on the inner front region of the lagging body are adapted to cut away the face exposed by these fixed bits. Preferably the depth of cutting effected by the fixed cutter bits at the front outer end region of the leading body is greater than the depth of cut effected by the adjustable bits on the inner end region of the lagging body on the face newly exposed by these fixed bits. In this way the total depth of cut can be made up of the cutting depth produced by the fixed bits, typically 40–60 mm, and the smaller cutting depth, typically 10–20mm, produced by the following-up adjustable bits on the front or inner end region of the lagging body. It follows that in relation to the uncut face the adjustable bits should project further than the fixed bits.

The distribution of the cutting or stripping work between the two plough bodies is advantageous from a number of view-points. It also assists with loading of the material into a scraper-chain conveyor which has the guide along its mineral face side. In relation to this loading aspect the bodies can be shaped to interact with a ramp surface of the guide, as will be described hereinafter in more detail, so that both bodies co-operate in loading.

The main or fixed cutter bits on the outer end regions of the bodies are preferably staggered so that the bits project further outward in a longitudinal sense, i.e. parallel to the directions of movement of the plough, in the direction of the floor of the working. Preferably, adjustable lower sets of bits on the facing inner end regions of the bodies are also similarly staggered.

In one constructional form of the plough there is an adjustable upper set of cutter bits at each end region of each body which is disposed above the other cutter bits at said end region, these upper sets of bits being mounted on carriers pivotable in relation to the body with the carriers being connected by means of a linkage so that when one of the upper sets of bits is brought into an operative position to engage the mineral face the other of the upper sets of bits is brought into an inoperative position and does not engage the mineral face. These upper sets of bits can be non-staggered, i.e. arranged one above another in aligned relationship. Moreover the adjustable staggered lower sets of bits at the inner region of each body can be mounted on a carrier pivotable in relation to the body to bring the bits into an operative position engageable with the mineral face or an inoperative position.

By constructing a plough in accordance with at least some of the foregoing features it is possible to employ the known form of arcuate carrier and guideway for the floor cutters without increasing the width of the bodies or the guide unduly. There is a limitation on the width of the plough bodies, i.e. in a direction laterally of the directions of movement of the plough, since the guide normally engages at or near the juncture between the floor and the mineral face so that only the operative cutting bits project inwardly to the face beyond the guide and hence the width of the plough body is more or less dependent on the width of the guide. An optimum width for the plough bodies also asists in ensuring efficient loading of the material detached by the cutter bits. The guide itself may be formed in generally known manner from a series of plates. It is preferable if the carrier for the floor cutter and the associated guide are disposed inwardly of the body relative to the positionally-fixed cutter bits. The floor cutters are preferably arranged so that they are capable of cutting immediately in front of the forward edge of the guide. It is advantageous to have the floor cutters each constructed to have two mutually-perpendicular cutting edges which extend substantially parallel to the floor of the working and to the mineral face respectively. The cutters can be detachably connected through a mounting to the associated carrier and these features enable the cutters to be replaced or interchanged or inverted at will. Any adjustment of the cutting height effected by the floor cutters can be achieved without altering the general cutting allowances and relatively easily.

The invention also provides a plough composed of two spaced-apart bodies interconnected to move together along a mineral face in alternate directions to win mineral therefrom with the aid of cutter bits mounted to the bodies, the cutter bits being arranged at each end region of each of the bodies relative to the direction of movement of the plough in a manner such that for each direction of movement of the plough the cutter bits at the forward end region of each body engages the mineral face while the cutter bits at the rear end region of each body do not engage the face.

A plough made in accordance with the invention can provide improved cutting and loading of mineral, e.g. coal, and yet can be of comparatively simple construction.

The invention may be understood more readily, and various other features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 3:
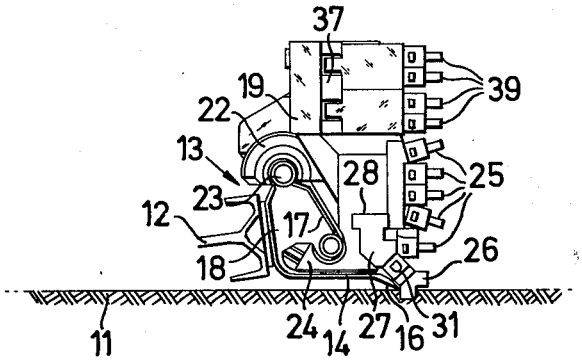
FIG. 3 is an end view of part of the plough, the view being taken in the direction of arrow III in FIG 1.
Figure 4:
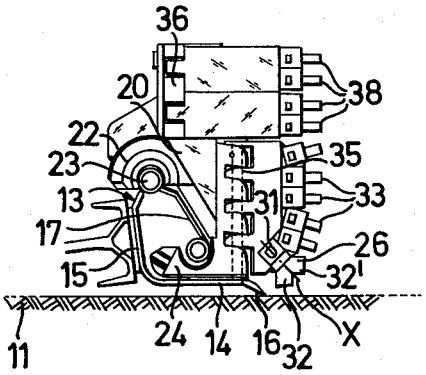
FIG. 4 is an end view of another part of the plough, the view being taken in the direction of arrow IV in FIG. 1.

As shown in the drawings, and in known manner, a mineral mining installation has a scraper-chain conveyor 12 arranged alongside a coal face 10 in a longwall mine working having a floor 11. As shown in FIGS. 3 and 4, the conveyor 12 has guide means 13 formed on its coal-face side for slidably guiding a coal plough and for loading material into the conveyor 12. This guide means 13 is composed of a series of plates of generally L-shaped cross-section having upstanding portions 15 affixed to the coal-face side of the conveyor 12 and forwardly-projecting foot portions 14 on which the plough rests. These feet portions 14 have downturned front edges 16 which engage on the floor 11 and which generally locate at the juncture between the floor 11 and the coal face to control the position of the plough and define its maximum cutting depth in known manner. Additional plates 17 complete the guide means 13. These plates 17 take an inclined position and are pivotably connected to the upper edges of the upstanding portions 15 of the other plates. The plates 17 slidably engage with the plough but also form a loading ramp guide surface for the material detached by the plough. The plates 17 and the upstanding portions 15 of the other plates define an interior space 18 which is subdivided in known manner (not shown in detail) to form upper and lower chain guide passages. The endless chain propelling the plough along the conveyor is circulated in these guide passages. The pivot connections between the upstanding portions 15 of the L-shaped plates and the plates 17 include tube 23 which also forms part of the guide for the plough.

Figure 1:
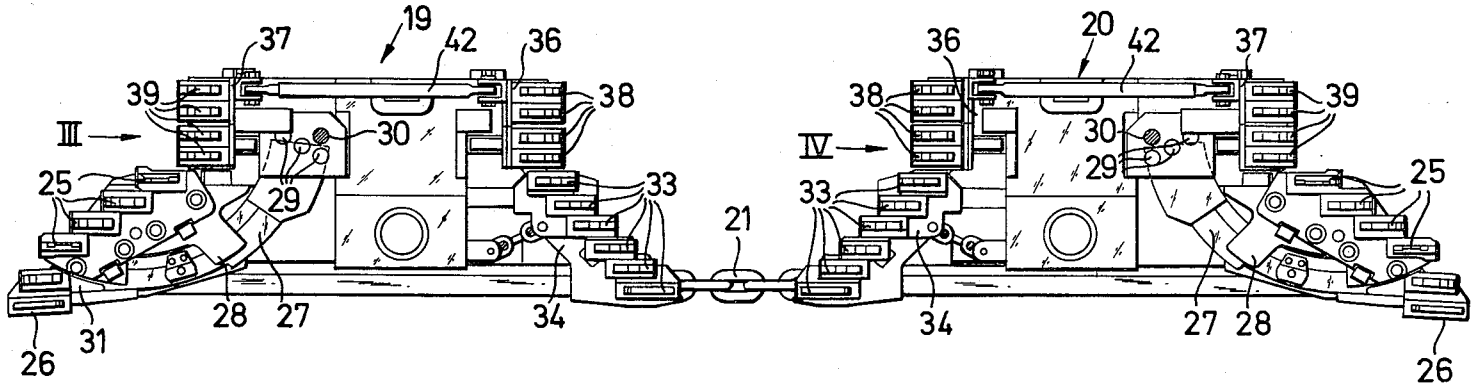
FIG. 1 is a front view of a coal plough made in accordance with the invention, the view being taken from the coal face.
Figure 2:
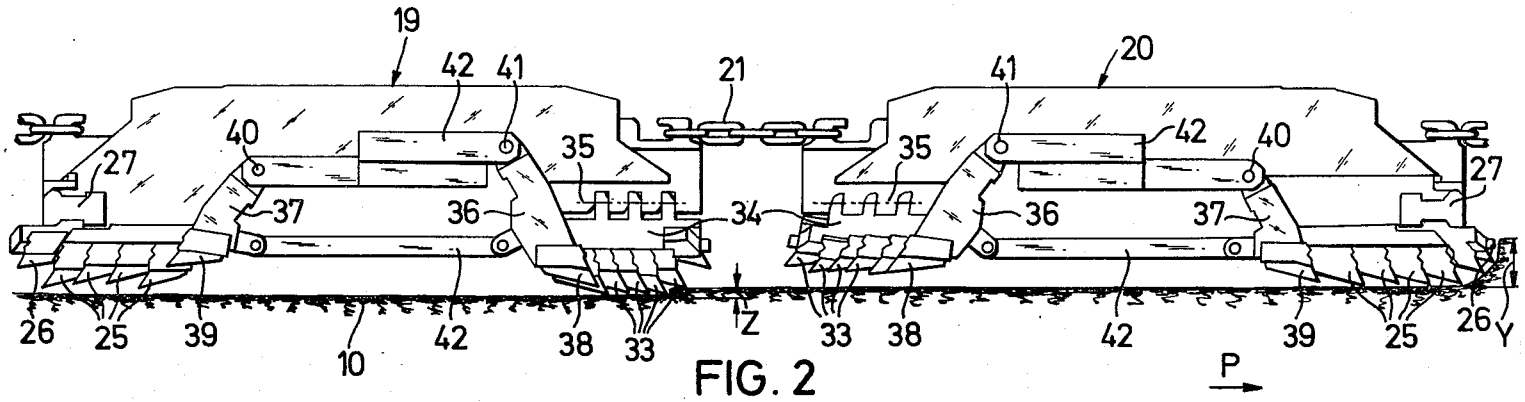
FIG. 2 is a plan view of the plough shown in FIG. 1.

As shown particularly in FIGS. 1 and 2, the plough itself is composed of two separate bodies 19, 20 which are of identical construction. The bodies 19, 20 are located on and guided by the guide means 13 and serve to detach material in both directions of travel of the plough along the conveyor 12. A short length of chain 21 serves to flexibly connect the bodies 19, 20 together. As can be seen from FIGS. 3 and 4, each body 19, 20 has a concave guide recess 22 which seats on the tubes 23 and a guide element 24 which projects through the gap between the lower edges of the plates 17 and the foot portions 14 of the L-shaped plates. These guide elements 24 have concave recesses shaped to receive the lower edges of the plates 17, which edges are of tubular form constructed by bending or by the attachment of further tubes. The elements 24 extend into the space 18 and connect with the lower run of the drive chain therein.

The bodies 19, 20 are each provided on the outer end region with cutter bits 25 which extend over a lower zone of the coal face 10 and which are staggered in a step-like formation as shown in FIG. 1 to project further outwards in the direction of the floor 11. In known manner these bits 25 are replaceable and are located in recesses or pockets on the bodies 19, 20 so as to be positionally fixed. Each body 19, 20 also has an adjustable floor cutter 26 which is detachably secured to a carrier 27 which is guided for movement along an arcuate guideway 28 in the body 19, 20.

These arcuate guideways 28 and the associated curved engaging parts of the carrier 27 preferably have a T-shaped cross-sectional profile as is known. The carriers 27 have a convex profile in relation to the floor 11 and can swing along the guideways 28 and within a vertical plane parallel to the coal face. Each body 19, 20 has a number of bores 29 staggered in the direction of movement of the associated carrier 27 and a stop pin 30 can be inserted into a selected one of these bores 29 to limit the movement of the carrier 27. In this way the effective cutting height of the floor cutters 26 can be adjusted.

As can be seen best from FIG. 3, the carriers 27 and their guideways 28 are located inwardly towards the conveyor 12 in relation to the cutter bits 25 and generally above the foot portions 14 of the L-shaped guide plates. The cutters 26 are attached to the carriers 27 by means of intermediate mountings 31 each having an axis X (FIG. 4) inclined at 45° in relation to the floor 11 and to the coal face 10. Each cutter 26 is a double unit symmetrical in relation to this axis X with cutting edges 32, 32′ mutually perpendicular to one another and extending substantially parallel to the floor 11 and to the face 10, respectively. The cutters 26 can thus be used in two alternative positions and can be interchanged. As can be appreciated from FIGS. 3 and 4, the floor cutters 26 operate on the floor 11 immediately before the edge 16 of the guide 13 and the cutting level established by the cutters 26 can be adjusted by the pins 30.

The two bodies 19, 20 are also provided on their mutually-facing inner end regions with sets of adjustable cutter bits 33 extending over a lower zone and also staggered in a similar manner to the bits 25. The bits 33 are supported in pockets in a pivotable carrier 34 and the pivotal axes of these carriers 34 is denoted by the chain-dotted lines 35 in FIGS. 2 and 4. Each axis 35 is parallel to the coal face 10 and inclines towards the floor 11 so that the axes 35 pertaining to the two bodies 19, 20 converge. Each carrier 34 can thus be pivoted to a position where the bits 33 are inoperative and spaced from the coal face 10 (as shown in FIG. 2 for the body 20) or to a position where the bits 33 are operative to engage the face 10 (as shown in FIG. 2 for the body 19).

Each body 19, 20 has further sets of adjustable cutter bits 38, 39 disposed above the bits 33, 25 respectively. These upper sets of bits 38, 39 are not staggered and are supported in pockets of pivotable carriers 36, 37 respectively. As with the bits 33, the carriers 36, 37 can being the bits 38, 39 into either an operative or an inoperative position. The carriers 36, 37 are pivotable about vertical shafts 40, 41 in the associated body 19, 20 and are interconnected by a mechanical linkage 42 so that when one set of bits 38 on a body 19, 20 is operative the other set of bits 39 is inoperative and vice versa.

FIG. 2 shows the operating position of the various components of the plough when the latter is being moved in the direction of arrow P. The cutter bits 25 of the leading body 20, which are positionally fixed to the body 20, attack the coal face 10 first and serve to strip material from the face with a cutting depth Y of about 3 to 6 cm. The bits 39 on the body 20, which are brought into their operative position by the linkage 42, cut the upper zone of the coal face and are adjusted to cut generally within this depth Y i.e. generally no greater than or equal to Y. The bits 33, 38 on the inner end region of the body 20 are inoperative and adjusted so as not to engage the coal face. In the case of the lagging body 19, which follows up the body 20 in the direction of movement, the bits 33 are adjusted to cut the face, as now exposed and defined by the bits 25, by a cutting depth Z of 10 to 30 mm. Similarly the bits 39 which strip the portion of the face exposed by the bits 39 cuts generally within this depth Z.

The bits 25, 39 on the outer end region of the lagging body 19 are again inoperative and do not engage the coal face. When the plough reaches the end of its travel along the coal face in the direction P the drive is reversed to bring it back along the face in the reverse direction, so that the body 19 now leads. The above described conditions again occur but the bits 25, 39 on the body 19 now produce the main or first stripping action to depth Y and the bits 33, 38 on the body 20, which are now made operative by the linkage 42 perform the follow-up cut to depth Z.

As can be appreciated, the total cutting depth of the plough during one pass along the coal face is the sum of the depths Y and Z.

Neither the bits 33, 38 on the body 20, nor the bits 25, 31 on the body 19 will suffer any wear during the movement of the plough in the direction P and in the reverse direction of movement the same applies to the bits 33, 38 on the body 20 and the bits 25, 39 on the body 19.

The provision of the adjustable bits 33, 38 on each body 19, 20 ensures that when these bits 33, 38 engage on the coal face to cut away the latter to the depth Z the bits 25, which are secured to the body 19, 20 and follow up, do not engage the face.

The actual bodies 19, 20 themselves are constructed, as is known, to provide loading surfaces, resembling ploughshares, which transfer the material detached from the face over the guide surface defined by the plates 7 and into the conveyor 12. In the case where the plough is moved in the direction P, the majority of material is detached by the leading bits 25, 39 on the body 20 and this material is transferred by the loading surface of the body 20 whereas the material detached by the bits 33, 38 following up is in turn guided with any residual material by the loading surface of the body 19.

The floor cutters 26 serve in known manner to adjust the effective height of the plough and control the movement of the plough.

It is possible for the bodies 19, 20 to be interconnected by means of a beam attached to the top of the bodies 19, 20. This beam can be provided with an arm extending over the conveyor 12 in the manner of a gantry and engaging with a guide rail provided on the side of the conveyor 12 remote from the coal face 10. This would assist the control stability and guidance of the plough. If desired, the beam itself can be provided with further cutter bits for cutting the roof zone of thicker coal seams above the bits 38, 39.

We claim:

1. In a mineral winning plough having first and second spaced-apart bodies interconnected to move together along a mineral face in alternate directions to win mineral therefrom each body having cutter bits mounted to it; the improvement comprising: cutter bits arranged at end regions of each of the first and second bodies respectively relative to the directions of movement of the plough, wherein for each direction of movement of the plough at least some of the cutter bits mounted on the leading end region of the second body projects towards the mineral face as yet uncut, by a greater distance than the cutter bits on the leading end region of the first of the bodies, said cutter bits on the first and second bodies traversing said mineral face at the same height.

2. In a mineral winning plough having first and second spaced-apart bodies interconnected to move together along a mineral face in alternate directions to win mineral therefrom each of said bodies having cutter bits mounted to it; the improvement comprising: separate sets of cutter bits at each end region of each of the bodies respectively relative to the directions of movement of the plough, each of said sets of cutter bits being mounted so that for each direction of movement of the plough the cutter bits at the forward end region of each body engage the mineral face while the cutter bits at the rear end region of each body do not engage the face, each of said separate sets of cutter bits on the first and second bodies traversing said mineral face at the same height.

3. A mineral winning plough comprising first and second interconnected bodies, means for guiding the movement of said bodies back and forth along a mineral face, each body being provided with at least one floor cutter adjustable in relation to the body, a first set of cutter bits positionally fixed in relation to each body and disposed at an outer end region of the body relative to the other body, a second set of cutter bits adjustable in relation to each first and second body and disposed at an inner end region of the body facing the other body, the adjustable second sets of cutter bits being arranged so that, during operation, for each direction of movement of the plough the adjustable second set of cutter bits on the second body are mounted to cut away the mineral face to ensure that the fixed first cutter bits at the outer end region of said second body do not engage on the mineral face, each of said first and second sets of cutter bits traversing the mineral wall at the same height.

4. A plough according to claim 3, wherein the fixed first cutter bits at the outer end region of the leading body, relative to the direction of movement of the plough, are adapted to cut away the mineral face and the adjustable second bits on the inner region of the lagging body are adapted to cut away the face exposed by said fixed first bits.

5. A plough according to claim 4, wherein each body has sets of adjustable cutter bits at both of the outer end regions and wherein the adjustable cutter bits at the inner end region of the leading body and the fixed and adjustable bits at the outer end region of the lagging body, relative to the direction of movement of the plough, do not engage the mineral face.

6. A plough according to claim 4, wherein the depth of cutting effected by the first fixed cutter bits at the outer end region of the leading body is greater than the depth of cut effected by the adjustable bits on the inner end region of the lagging body on the face newly exposed by said first fixed bits.

7. A plough according to claim 3, wherein said at least one floor cutter is mounted on a carrier said flow cutter engaging with an arcuate guide on the body and displaceable along the guide to adjust the height of the floor cutter.

8. A plough according to claim 7, wherein said at least one floor cutter has two mutually-perpendicular cutting edges which extend substantially parallel to the floor of the working and to the mineral face, respectively.

9. A plough according to claim 7, including means to adjust the height of said at least one floor cutter, said means including a stop pin insertable in a selected one of a group of bores provided on the associated body, the stop pin serving to engage on the carrier to limit the displacement thereof along the guide.

10. A plough according to claim 5, further including an adjustable upper set of cutter bits at each end region of each body disposed above the other cutter bits at said end region, said upper sets of bits being mounted on carriers pivotable in relation to the body, the carriers being connected by means of a linkage whereby when one of the upper sets is brought into an operative position to engage the mineral face, the other of the upper sets of bits is brought into an inoperative position and does not engage the mineral face.

11. A plough according to claim 10, wherein the cutter bits constituting each upper set of bits are disposed one above another in aligned relationship.

12. A plough according to claim 10, wherein there is an adjustable lower set of cutter bits at the inner end region of each body, said lower set of bits being mounted on a carrier pivotable in relation to the body to bring the bits into an operative position engageable with the mineral face or an inoperative position.

13. A plough according to claim 12, wherein the adjustable lower set of cutter bits and the positionally fixed cutter bits on each body are staggered so that each bit projects further outwards from the body, parallel to the directions of movement of the plough, in the direction of the floor of the mine working.

14. A plough according to claim 7, wherein the carrier for the floor cutter and the associated guide are disposed inwardly of the body relative to the positionally-fixed cutter bits.

15. A plough according to claim 3, wherein the guide means comprises plates attached to a scraper-chain conveyor and the bodies serve to transfer detached mineral into the conveyor via a loading guide surface on the plates as the plough is moved.

16. A coal plough structure comprising: two separate ploughs flexibly connected to the movable together in unison back and forth along a coal face to strip coal therefrom with the aid of cutters carried by the ploughs, each of the ploughs provided with corresponding sets of cutters extending over the same height at both their inner and outer facing ends relative to the directions of movement, floor cutters with mutually perpendicular cutting edges disposed on said ploughs, means for adjusting the cutting height of the floor cutters, means mounting sets of cutters at the ends of each plough on the plough to control the adjustment thereof wherein as one set of cutters moves towards the coal face another set of cutters moves away from the coal face to extent of such movement of the mutually inwardly facing sets of cutters on the respective ploughs being greater than the movement of the outwardly facing sets of cutters on the ploughs, whereby when the plough is moved in one direction outwardly facing cutters on the leading plough first cut the coal face while cutters on the lagging plough facing the leading plough next cut the coal face over the same height region.

* * * * *